United States Patent [19]

Basmadji et al.

[11] Patent Number: 4,662,421

[45] Date of Patent: May 5, 1987

[54] UNIVERSAL VALANCE ASSEMBLY

[76] Inventors: Mounir P. Basmadji, 10380 Romuald Trudeau, Montreal, Quebec, Canada, H4N 1X6; Michael Ruinsky, 35 Dalecroft Circle, Unionville, Ontario, Canada

[21] Appl. No.: 804,088

[22] Filed: Dec. 3, 1985

[51] Int. Cl.[4] ..... E06B 9/00

[52] U.S. Cl. ..... 160/38; 16/94 D; 160/39

[58] Field of Search ..... 160/19, 38, 39, 178 R; 16/94 D

[56] References Cited

U.S. PATENT DOCUMENTS

| | | | |
|---|---|---|---|
| 2,664,946 | 1/1954 | Kravitz | 160/39 |
| 2,752,991 | 7/1956 | Charbonmeau | 160/34 |
| 4,079,770 | 3/1978 | Woodle | 160/39 X |
| 4,254,813 | 3/1981 | Vecchiarelli | 160/38 X |
| 4,254,814 | 3/1981 | Vecchiarelli | 160/19 |
| 4,384,605 | 5/1983 | Schaeffer et al. | 160/38 |
| 4,399,856 | 8/1983 | Anderson | 160/39 |

FOREIGN PATENT DOCUMENTS

| | | | |
|---|---|---|---|
| 452944 | 11/1948 | Canada | 160/39 |
| 795147 | 5/1958 | United Kingdom | 160/39 |

*Primary Examiner*—Robert W. Gibson, Jr.

*Attorney, Agent, or Firm*—Ridout & Maybee

[57] ABSTRACT

A universal valance assembly is disclosed. In one embodiment, the valance assembly is mountable on headrails of inverted channel cross-section, such as is commonly used for hanging vertical blinds. In another embodiment, the valance assembly is mountable on a headrail of channel cross-section, such as is used for hanging horizontal blinds of varying width. In either case, the valance assembly comprises a groover face element for holding decorative material, and groover return elements which are mounted at opposite ends of the groover face elements by means of corners which join the groover elements at substantially right angles. In the case of headrails of inverted channel cross-section, the assembled groover elements, making up the valance assembly, are mounted on the headrail with one or more groover-receiving brackets, provided with rearwardly-extending arms and a clip mounted adjacent a remote end of the rearwardly-extending arm for engaging exterior grooves defined in the walls of the headrail. In the case of a headrail of channel configuration, the clips mounted at a remote end of the rearwardly-extending arm of the groover-receiving bracket are engageable with curved lips on opposite inner walls of the headrail, and the clips are further adjustable to different widths of headrail for use on venetian, micro and mini blinds.

11 Claims, 6 Drawing Figures

UNIVERSAL VALANCE ASSEMBLY

BACKGROUND OF THE INVENTION

1. Field of the Invention

The present invention relates to valance assemblies for concealing the headrail of window coverings and the like, including both vertical and horizontal blinds.

2. Description of the Related Art

Various forms of valance assemblies have been proposed for vertical blinds and others for horizontal blinds.

In the case of vertical blinds, it is usual, for aesthetics, to provide a valance covered with the same fabric as that of the hanging louvers, and such valances presently require custom manufacturing. To form the face valance element, in some cases the fabric is glued onto a strip of rigid backing material. In other cases, the fabric is held by longitudinal flanges to an L-shaped bracket which extends the length of the headrail. In order to provide a finished appearance, a pair of valance returns utilizing the same fabric, must also be prepared in the same manner, and the complete valance assembled, using glue or staples to assemble the returns to the face valance element. Both types of assemblies are relatively expensive to manufacture.

In the case of horizontal blinds, the aesthetics of using a similar material for slats and valance is not as important. By far, the largest market of horizontal blinds have either white or ivory slats.

In recent years, a number of descendants have been developed from the standard venetian blind, including mini-blinds with one inch wide slats and micro-blinds with one-half inch slats.

With vertical blinds, the headrail is generally a length of extruded aluminum of standard inverted channel cross section.

However, in the case of horizontal blinds, the headrail is generally a length of extruded aluminum of upright channel of non-standard cross-section with rolled upper edges, and the width of the headrail varies according to the width of the slats.

One particular valance mounting assembly for vertical blinds employs a support having a U-shaped clip with downwardly extending front and rear arms. The U-shaped clip is designed to engage the front-facing wall of the headrail channel.

In other assemblies, the clip may be a plate with cantilevered tongues or weakened lines of severance to bend back and allow the clip to be inserted in the headrail channel, engaging the upper rolled edges.

SUMMARY OF THE INVENTION

The present invention is directed to providing a valance and valance mounting assembly which can be easily constructed and of which at least some elements can be universally used with vertical or horizontal blinds or other types of window coverings employing a headrail of the type described.

According to one aspect of the present invention there is provided a valance assembly for mounting on a headrail of inverted channel cross-section, wherein the headrail has an upper web, and front and rear walls downwardly extending from the upper web and with grooves defined in the front and rear walls adjacent and extending parallel to the upper web. This valance assembly comprises a groover face element having inwardly directed L-shaped flanges extending along an upper and a lower edge of the groover face element defining upper and lower longitudinally-extending slots for receiving decorative material, a groover-receiving bracket having upper and lower inwardly directed L-shaped flanges for snugly engaging respective upper and lower edges of the groover face element whereby to mount the groover as well as an integral rearwardly-extending arm, and a clip mounted adjacent a remote end of the rearwardly-extending arm of the groover-receiving bracket. The clip has a hook projecting from one end thereof for engaging the groove defined in the rear wall of the headrail, and also a curved lip projecting from an opposite end thereof for engaging the groove defined in the front wall of the headrail.

Preferably, this valance assembly will further comprise at least one groover return element of substantially the same configuration as the groover face element, except as to length, and at least one corner having first and second longitudinally-extending elements of V-shaped cross-section mounted in spaced relationship defining two longitudinal slots therebetween, one slot snugly receiving an end of the groover face element and the other slot snugly receiving an end of the groover return element, thereby joining the groover elements at a substantially right angle. The material forming the groover face element and groover return element is shearable.

The clip can be either integrally formed with the rearwardly-extending arm of the groover-receiving bracket, or else the rearwardly-extending arm can be provided with a slotted aperture adjacent its remote end and the clip can be further provided with releasable mounting means which extend through the aperture to secure the clip to the rearwardly-extending arm, thus allowing for adjustment of the groover face element relative to the headrail.

In another embodiment of the invention, a kit for assembling a valance for mounting on a headrail as previously described is provided which consists of a shearable groover having inwardly directed L-shaped flanges extending along an upper and a lower edge of the groover face element defining upper and lower longitudinally-extending slots for receiving decorative material from which a groover face element and at least one groover return element can be cut, at least one groover-receiving bracket as previously described and a clip mounted adjacent a remote end of said groover-receiving bracket as previously described, as well as at least one corner of the type previously described.

In a further embodiment of the invention, an adjustable valance assembly for mounting on a headrail of upright channel cross-section having edge portions rolled over inwardly into the channel is provided. This adjustable valance assembly consists of a groover face element having inwardly directed L-shaped flanges extending along an upper and a lower edge of the groover face element defining upper and lower longitudinally-extending slots for receiving decorative material, a groover-receiving bracket having upper and lower inwardly directed L-shaped flanges for snugly engaging respective upper and lower edges of the groover face element whereby to mount the groover and an integral rearwardly extending arm with an aperture defined adjacent a remote end thereof, and two headrail adaptor clips. Each headrail adaptor clip has a slotted aperture defined therein and a curved lip engageable with one of the edge portions of the headrail projecting therefrom adjacent an end of the slotted aperture. The adjustable valance assembly is further provided with releasable means for securing the two headrail adaptor clips and the rearwardly-extending arm of the groover receiving bracket through their respective apertures so that the two headrail adaptor clips will be oppositely disposed with the respective curved lips engageable concurrently with opposite edge portions of the headrail.

A groover return element along with a corner for mounting the groover return element at a substantially right angle to the groover face element, as previously described, may also be provided. Preferably, both the groover face element and the groover return element will be shearable.

A final embodiment of the invention provides a kit for assembling an adjustable valance for mounting on a headrail of upright channel cross-section having edge portions rolled over inwardly into the channel. In the kit, a shearable groover, as previously described, is provided from which a groover face element and at least one groover return element may be cut. Also provided in the kit is at least one groover-receiving bracket having upper and lower inwardly directed L-shaped flanges for snugly engaging respective upper and lower edges of the groover face element whereby to mount the groover and an integral rearwardly extending arm with an aperture defined adjacent a remote end thereof. At least two headrail adaptor clips are also provided, each headrail adaptor clip having a slotted aperture defined therein and a curved lip engageable with one of the edge portions of the headrail projection therefrom adjacent an end of the slotted aperture. Also provided are releasable means for securing the two headrail adaptor clips and the rearwardly-extending arm of the groover-receiving bracket through the respective apertures in order to form a clip which will be engageable with opposite edge portions of the headrail.

DETAILED DESCRIPTION OF PREFERRED EMBODIMENTS

Figures 1, 2, 3:
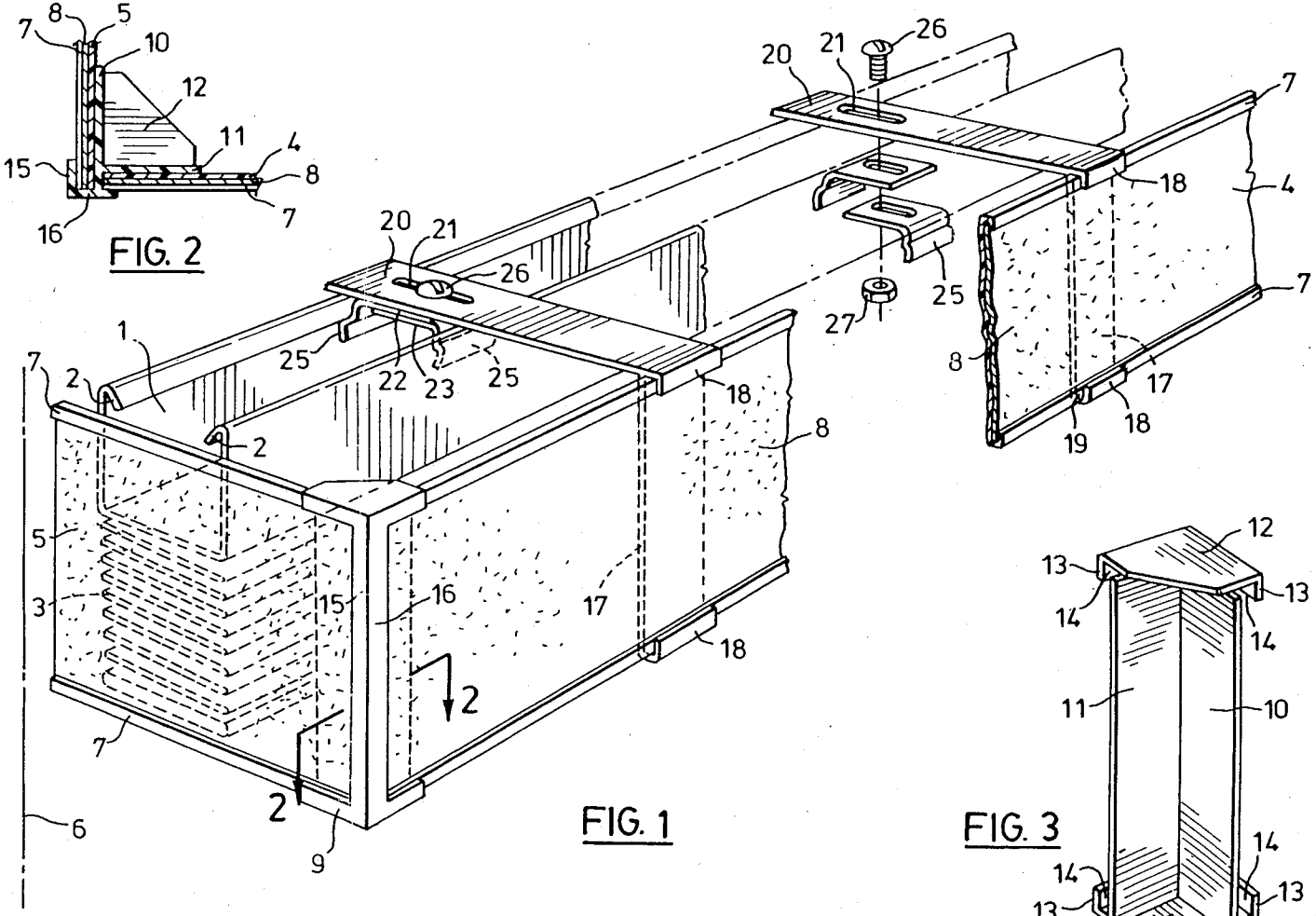
FIG. 1 shows an adjustable valance-mounting assembly for horizontal blinds, according to one aspect of the invention.
FIG. 2 shows a cross-sectional view of a corner assembly taken along line 2—2 of FIG. 1.
FIG. 3 shows a rear view of a corner for assembling a valance according to the present invention.

Referring to FIG. 1, a valance assembly is disclosed according to one aspect of the invention.

A headrail 1 of upright channel cross section is provided with inwardly-rolled upper edges 2. From the headrail 1 are suspended a number of horizontal slats 3, although the mechanism for suspending and controlling the slats is not shown in the drawings and forms no part of the invention.

According to the present invention, a valance is formed of a groover face element 4 which is the length of the headrail, and a groover return element 5. After assembly and mounting, the groover face element 4 will conceal the front of the headrail, while a groover return element 5 at each end of the groover face element 4 in most applications, will conceal the ends of the headrail, extending back from the groover face element 4 toward the wall or window frame 6 on which the headrail will be mounted.

The groover material for both the groover face element and groover return element is preferably a resiliently flexible and shearable material, such as light plastic, e.g. PVC, to facilitate flexing and snapping of the parts together in home installation and to facilitate cutting of the groover elements to fit the particular headrail. Inwardly-directed L-shaped flanges 7 extending the length of the upper and lower edges of both groover elements 4 and 5 define longitudinally-extending slots in which lengths of decorative material, such as fabric 8, may be inserted the length of each of the groover elements and, by engaging in the slots, will be held in place by edge flanges 7.

From FIG. 1, it can be seen that the groover elements 4 and 5 are mounted, relative to each other, at a substantially right angle. The means for securely mounting the groover elements one to another is corner 9, which is independently shown from different perspectives in FIGS. 2 and 3.

As can be seen from FIG. 3, walls 10 and 11 of the corner intersect at a right angle to form a first V-shaped channel member.

Mounted on the walls 10 and 11 at either end are abutments 12 with overhanging flanges 13 spaced from the inverted channel side of walls 10 and 11 to define slots 14.

As can be seen from FIG. 2, the width of slots 14 is sufficient for snugly receiving the total thickness of groover element 4 or 5 and flanges 7. Corner 9 is also provided with columns 15 and 16, shown in FIG. 1, which intersect at a right angle to form a second V-shaped channel member. Columns 15 and 16 are longitudinal extensions of flanges 13 (and can be integrally formed to their width) and are also mounted between abutments 12, being thereby spaced respectively from walls 10 and 11, and defining slots therebetween of the same width as slots 13.

A preferred embodiment of the corner 9 is shown in FIG. 2, in which it can be seen that wall 10 extends beyond the intersection with wall 11 to intersect with column 16, providing an abutment for groover element 4 inserted in the slot 14.

Preferably, the corner 9 is formed of hard plastic for durability, which may be of clear color for aesthetics.

In use, ends of the groover elements 4 and 5 are inserted and snugly engaged in the slots 14.

Once the valance is assembled, complete with fabric 8 or other decorative material in the groover elements, the valance may be mounted on the headrail using a valance-mounting bracket of the present invention.

A groover-receiving bracket 17 is provided with upper and lower inwardly-directed L-shaped flanges 18 which define therebetween slots 19 for snugly receiving an edge of a groover element including its edge flange 7. The distance between the upper and lower flanges 18 of a groover-receiving bracket 17 is desirably such that the groover element 4 can be flexed laterally and snapped into snug gripping engagement in the groover-receiving bracket 17, as shown. Desirably the bracket 17 is of flexibly resilient plastic, so that it grips resiliently on the groover element 4 and can be flexed open to detach it from the groover element 4, if desired.

The groover-receiving bracket 17 is further provided with an integrally-formed, rearwardly-extending arm 20.

In the case of the type of headrail shown in FIG. 1, the rearwardly-extending arm 20 has an aperture 21 which is formed adjacent the remote end of the rearwardly-extending arm, which aperture is preferably of slotted configuration.

Because the width of the headrail shown in FIG. 1 will vary according to the width of the slat or other window covering suspended from it, it is necessary to provide a mounting for the groover-receiving bracket which is adaptable to different widths. In the present invention, an adjustable clip assembly has been provided which is shown in FIG. 1 in both assembled and exploded views.

Headrail adaptor clips 22 and 23 are provided, each of which has a slotted aperture 24 and a curved lip 25 extending adjacent an end of the slotted aperture 24.

The two headrail adaptor clips 22 and 23 are secured together and to the rearwardly-extending arm 20 of the groover receiving bracket 17 by passing fastening means, such as bolt 26 and nut 27, through their respective slotted apertures 24 and 21. In addition, headrail adaptor clips 22 and 23 must be positioned with their respective curved lips 25 oppositely disposed and preferably spaced apart at their widest points slightly greater than the inside width of the headrail.

Each curved lip 25 is engageable with one of the rolled-over edges 2 of the headrail 1 and is comprised of a slightly springy material, such as spring steel or aluminum, allowing a snap engagement of the assembled mounting into the headrail channel 1.

Figure 4:
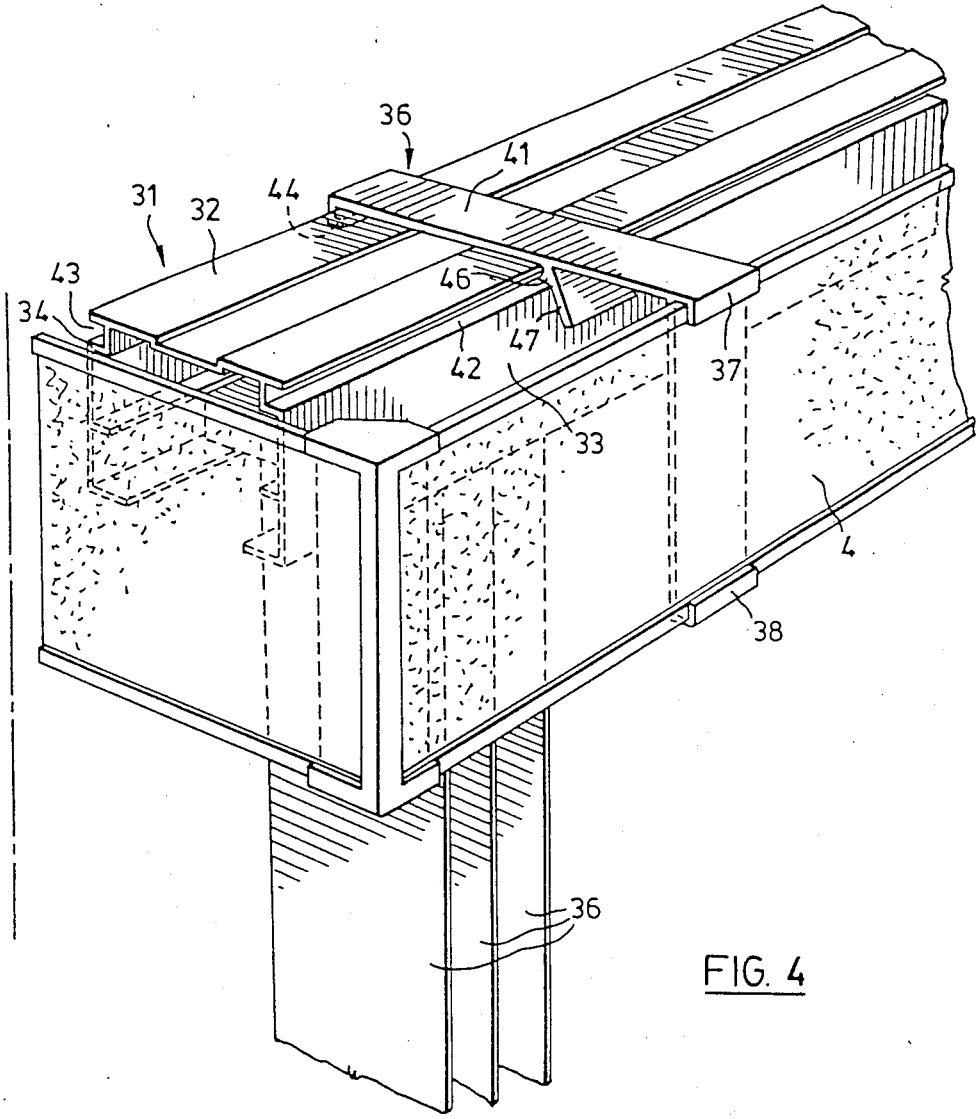
FIG. 4 shows a valance-mounting assembly for vertical blinds according to another aspect of the invention.

FIG. 4 shows an arrangement for vertical blinds having a headrail 31 of inverted channel section with an upper web 32 and front and rear walls 33 and 34. The rail 31 holds the mechanism suspending and controlling the slats 36. Like reference numerals in the drawings indicate like parts. The groover face element 4 in this example, however, is mounted on the headrail 31 by a resiliently flexible plastic bracket 36 having upper and lower inwardly directed L-shaped flanges 37 and 38 for snugly engaging the upper and lower edges of the groover face element 4, and an integral rearwardly extending arm 41. The portion of the arm remote from the flanges 37 and 38 is formed as a clip for snap-engaging grooves 42 and 43 in the front and rear walls 33 and 34 of the headrail and adjacent and extending parallel to the upper web 32. The clip arrangement comprises at one end a hook 44 projecting from one end and engaging in the groove 43 and, at the opposite end, a curved lip 46 projecting from an inner side of a downwardly and forwardly extending flange 47. When the arm 41 is pressed downward toward the web 32, the flange 47 is deflected outwardly by the upper corner of the rail 31 until the lip 46 snaps into the groove 42. The flange 47 provides a finger grip so that on pressing the flange 47 outwardly the lip 46 can be disengaged from the groove 42, to allow disassembly or adjustment of the valance.

Figure 5:
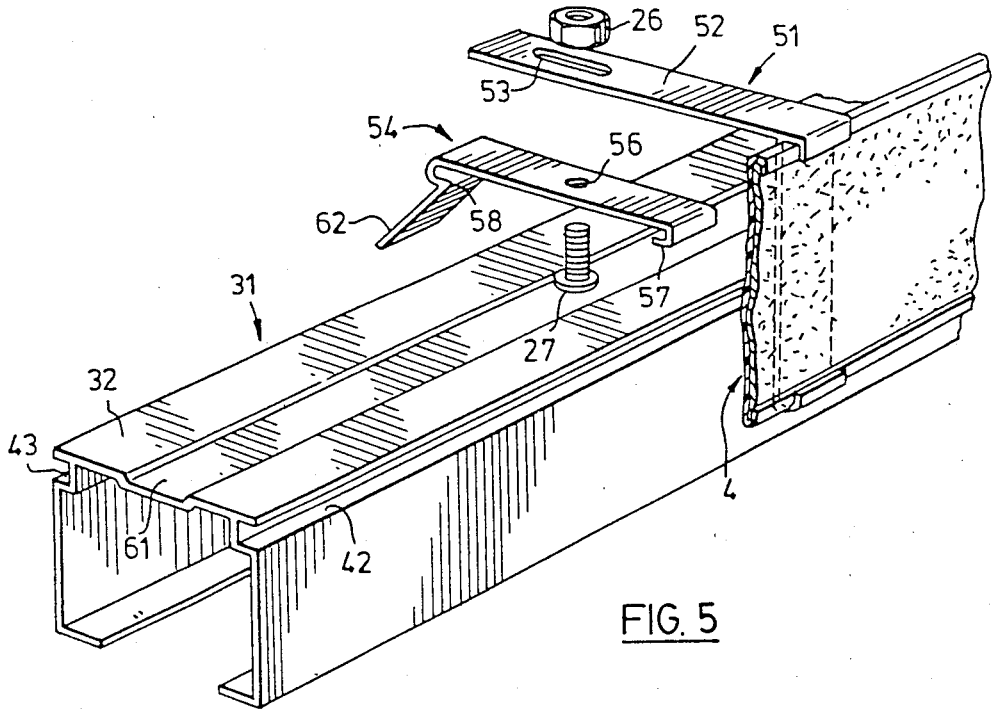
FIGS. 5 and 6 show a partial perspective view, in exploded form, and a partial end view, respectively, of a valance-mounting assembly for vertical blinds according to a still further aspect of the present invention.
Figure 6:
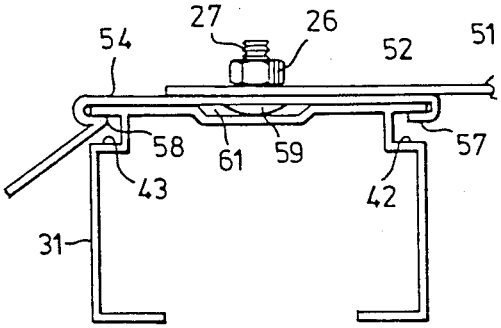

FIGS. 5 and 6 show a further form wherein the element 4 is attached to the rail 31 by a bracket 51 with a rearwardly extending arm 52 formed with a slot 53. A spring steel, other resilient metal or resilient plastic clip 54 is connected to the arm 52 by a fastener, e.g. nut 27 and bolt 26 used in inverted position relative to that of FIG. 4, passed through the slot 53 and through a hole 56 in an upper, planar, portion of the clip 54. Adjacent one end, the clip 54 is formed with a re-entrant flange 57 which enters one groove, e.g. the front groove 42 of the rail, and adjacent the other end the clip is bent in a sinusoidal fashion, forming an inwardly-directed intermediate portion or curved lip 58, which, in use, enters into a groove, e.g. the rear groove 43, and underneath the adjacent edge of the upper web 32 of the rail 31 and engages the edge of the web 32, so that, when the fastening means is tightened up, the arm 52, together with the bracket 51, is held securely to the rail 31. As will be appreciated, the position of the clip 54 may be reversed from that shown, with the flange 57 entering the rear groove 43 and the lip 58 entering the front groove 42. Desirably, the bolt 27 is formed with a head 59 which is sufficiently shallow to be accommodated between a central longitudinal channel recess 61 in the upper web 32 of the rail 31 and the underside of the planar portion of the clip 54 when the latter is pressed flat on the web 32. The sinusoidally bent end portion of the clip 54 continues in an outwardly and downwardly extending tab portion 62, permitting quick release of the bracket, if desired, by levering the tab portion 62 upwardly and outwardly with the fingers, to disengage the inwardly-directed portion or lip 58 from the groove 42 or 43 in which it is seated.

We claim:

1. A valance assembly for mounting on a headrail of inverted channel cross-section, the headrail having an upper web and front and rear walls downwardly extending from said upper web, with grooves defined in the front and rear walls adjacent and extending parallel to the upper web, comprising:

a groover face element having inwardly-directed L-shaped flanges extending along an upper and a lower edge of the groover face element defining upper and lower longitudinally-extending slots for receiving decorative material;

a groover-receiving bracket having upper and lower inwardly directed L-shaped flanges for snugly engaging respective upper and lower edges of the groover face elements whereby to mount the groover, and an integral rearwardly-extending arm;

a clip mounted adjacent a remote end of the rearwardly-extending arm of the groover-receiving bracket, said clip having a hook projecting from one end thereof for engaging the groove defined in the rear wall of the headrail, and a curved lip projecting from an opposite end thereof for engaging the groove defined in the front wall of the headrail;

at least one groover return element of substantially the same configuration as the groover face element, except as to length; and at least one corner having first and second longitudinally-extending elements of V-shaped cross-section mounted in spaced relationshpip defining two longitudinal slots therebetween, one slot snugly receiving an end of the groover face element and the other slot snugly receiving an end of the groover return element thereby joining said groover elements at a substantially right angle.

2. The valance assembly according to claim 1, wherein the at least one corner further comprises abutments protruding from the V-shaped members and positioned at opposite ends of the two longitudinal slots to limit longitudinal movement of the ends of the groover members mounted in said slots.

3. The valance assembly according to claim 1, wherein the groover face element and the groover return element are shearable.

4. The valance assembly according to claim 1, wherein the rearwardly-extending arm has a slotted aperture defined adjacent its remote end, and the clip further comprises releasable mounting means which extend through the aperture and secure the clip to the rearwardly-extending arm, whereby the groover face element may be adjusted relative to the headrail.

5. The valance assembly according to claim 1, wherein the clip is integrally formed with the rearwardly-extending arm of the groover-receiving bracket.

6. A kit for assembling a valance for mounting on a headrail of inverted channel cross-section, the headrail having an upper web and front and rear walls downwardly extending from said upper web, with grooves defined in the front and rear walls adjacent and extending parallel to the upper web, comprising:

a shearable groover having inwardly directed L-shaped flanges extending along an upper and a lower edge thereof defining upper and lower longitudinally-extending slots for receiving decorative material, from which shearable groover a groover face element and at least one groover return element can be cut;

at least one groover-receiving bracket having upper and lower inwardly-directed L-shaped flanges snugly engageable with respective upper and lower edges of the shearable groover, an integral rearwardly-extending arm and a clip mounted adjacent a remote end of the rearwardly-extending arm, said clip having a hook projecting from one end thereof for engaging the groove defined in the rear wall of the headrail, and a curved lip projecting from an opposite end thereof for engaging the groove defined in the front wall of the headrail; and at least one corner having first and second longitudinally extending elements of V-shaped cross-section mounted in spaced relationship defining two longitudinal slots therebetween, each slot capable of snugly receiving an end of the shearable groover.

7. An adjustable valance assembly for mounting on a headrail of upright channel cross section provided with edge portions rolled over inwardly into the channel, comprising:

a groover face element having inwardly directed L-shaped flanges extending along an upper and a lower edge of the groover face element defining upper and lower longitudinally-entending slots for receiving decorative material;

a groover receiving bracket having upper and lower inwardly-directed L-shaped flanges for snugly engaging respective upper and lower edges of the groover face element whereby to mount the groover face element, and an integral extending arm with an aperture defined adjacent a remote end thereof;

two headrail adaptor clips, each headrail adaptor clip having a slotted aperture defined therein and a curved lip engageable with one of the edge portions of the headrail projecting therefrom adjacent an end of the slotted aperture; and releasable means for securing the two headrail adaptor clips and the rearwardly-extending arm of the groover-receiving bracket through their respective apertures, whereby the two headrail adaptor clips will be oppositely disposed with their respective curved lips engageable concurrently with opposite edge portions of the headrail.

8. The adjustable valance assembly according to claim 7, further comprising:

at least one groover return element of substantially the same configuration as the groover face element, except as to length; and at least one corner having first and second longitudinally-extending elements of V-shaped cross-section mounted in spaced relationship defining two longitudinal slots therebetween, one slot snugly receiving an end of the groover face element and the other slot snugly receiving an end of the groover return element, thereby joining said groover elements at a substantially right angle.

9. The adjustable valance assembly according to claim 8 wherein the at least one corner further comprises abutments protruding from the V-shaped members and positioned at opposite ends of the two longitudinal slots to limit longitudinal movement of the ends of the groover elements mounted in said slots.

10. The adjustable valance assembly according to claim 8, wherein the groover face element and the groover return element are shearable.

11. A kit for assembling an adjustable valance for mounting on a headrail of upright channel cross-section provided with edge portions rolled over inwardly into the channel, comprising:

a shearable groover having inwardly-directed L-shaped flanges extending along an upper and a lower edge of the groover face element defining upper and lower longitudinally-extending slots for receiving decorative material from which shearable groover a groove face element and at least one groover return element can be cut;

at least one groover-receiving bracket having upper and lower inwardly-directed L-shaped flanges snugly engageable with respective upper and lower edges of the groover face element and an integral rearwardly-extending arm with an aperture defined adjacent a remote end thereof;

at least two headrail adaptor clips, each headrail adaptor clip having a slotted aperture defined therein and a curved lip engageable with one of the edge portions of the headrail projecting therefrom adjacent an end of the slot; and at least one corner having first and second longitudinally-extending elements of V-shaped cross-section mounted in spaced relationship defining two longitudinal slots therebetween, each slot being capable of snugly receiving an end of the shearable groover.

* * * * *